US005867848A

United States Patent [19]

Ort

[11] Patent Number: 5,867,848

[45] Date of Patent: Feb. 9, 1999

[54] METHOD AND APPARATUS FOR PROVIDING A URINE-ACTIVATED THERMOCHROMIC DISPLAY SCREEN

[76] Inventor: Randall C. Ort, 6411 Fawnwood Dr., Spring, Tex. 77388

[21] Appl. No.: 831,778

[22] Filed: Apr. 9, 1997

[51] Int. Cl.[6] ..... A47K 3/12

[52] U.S. Cl. ..... 4/661; 4/902

[58] Field of Search ..... 4/661, 902, DIG. 5, 4/309

[56] References Cited

U.S. PATENT DOCUMENTS

| | | | |
|---|---|---|---|
| D. 258,181 | 2/1981 | Adam | 4/661 |
| 2,776,438 | 1/1957 | Zeraffa | 4/134 |
| 4,459,046 | 7/1984 | Spirg | 374/162 |
| 5,363,516 | 11/1994 | Butts | 4/661 |

*Primary Examiner*—David J. Walczak

*Attorney, Agent, or Firm*—Michael Roebuck

[57] ABSTRACT

A thermochromic urinal display apparatus and method for displaying a message when activated by a warm urine stream and terminating the display when the apparatus is rinsed with cool rinse water. A urinal display screen is disclosed with advertisement, slogans, public service messages either painted, printed, screened or incorporated onto the urinal display screen using thermochromic paint, ink, film or decal. The urinal display screen is placed so that the thermochromic display is above the water line in the urinal reservoir. The warm urine stream activates the thermochromic paint to induce opaqueness or clarity to reveal advertising slogans, public service messages to the user. Once flushed the cool water from the urinal rinse deactivates the thermochromic paint so that it returns to its original state thereby becoming opaque to conceal an underlying message from the next user. The message can be printed in thermochromic paint in a quiescent transparent state to become activated and visible in its active opaque state.

13 Claims, 3 Drawing Sheets

METHOD AND APPARATUS FOR PROVIDING A URINE-ACTIVATED THERMOCHROMIC DISPLAY SCREEN

BACKGROUND OF THE INVENTION

1. Field of the Invention

The present invention relates generally to urinals and in particular to a urine activated thermochromic display method and apparatus for urinals.

2. Description of the Related Art

Thermochromic compositions are known in the art. For example, U.S. Pat. No. 5,585,425 teaches a thermochromic opaque/transparent composition which is capable of exhibiting change in transparency together with a change in color in response to temperature variation.

U.S. Pat. No. 4,826,550 teaches a thermochromic color-memory composition exhibiting high color contrast between high color density in a colored state and sufficiently low color density in a decolored state with a high freedom of selection of the reaction medium, and highly useful as a thermochromic material.

Moreover, urinal and toilet devices are known in the art. For example U.S. Pat. No. 4,773,863 discloses an amusement device for a toilet bowl comprising a urine detector for detecting a urine flow from a human and for providing an electric signal for activating a sensory stimulus device.

U.S. Pat. No. D0, 253,145 discloses an ornamental urinal screen and U.S. Pat. No. 5,499,008 discloses a method and apparatus for providing artificial sounds in the vicinity of a toilet.

None of these patents or any other patent known to the inventor of the present invention disclose or suggest the improvements and advantages which are provided by the present invention. With the aid of this specification, many of these improvements and advantages will become obvious to a person of ordinary skill in the art.

SUMMARY OF THE INVENTION

The present invention provides a urine-activated thermochromic urinal display method and apparatus. The method and apparatus of the present invention enables an advertising slogan, public service message or other visibly perceptive ornamentation to become visible to a subject during urination. The urine-activated thermochromic urinal display method and apparatus of the present invention utilizes a thermochromic composition which is capable of exhibiting a change in transparency so that it appears in either an opaque and transparent state. During its quiescent state, when exposed to normal room temperatures, the thermochromic coating appears as opaque. In the opaque state, the thermochromic coating is visible. The coating can be formed into an ornamental design so that in the opaque state an ornamental design is visible. When doused with urine, however, the thermochromic coating changes state to its active transparent state, revealing a message printed underneath the thermochromic coating. When the urinal apparatus is doused with urine, which is at body temperature, the thermochromic coating is activated by the elevated temperature of the urine and the ornamental design becomes transparent, thus revealing an advertising slogan or announcement underneath the ornamental design which was previously not visible behind the opaque thermochromic coating.

When the apparatus is rinsed with cool water the thermochromic design returns to its inactive quiescent state and becomes opaque again, thereby masking the underlying slogan or design so that it is no longer visible. In an alternative embodiment the urinal display method and apparatus of the present invention utilizes a message written using thermochromic coating. In its quiescent state, the thermochromic message is transparent and thus not visible. When activated by a urine stream the thermochromic message becomes opaque and thus visible. When doused with cool rinse water or left to return to room temperature, the thermochromic message returns to its quiescent transparent state and is no longer visible.

The present invention provides an opportunity to present an appropriate message in an unexpected and memorable way. The appearance of a message or logo unexpectedly during urination produces surprise and delight in the viewer. The emotional impact on the viewer raises the level of interest in the message and its intended effect on the viewer. Messages such as "Don't Drive Drunk" or "Call a Cab" may have the effect of saving a human life. There are many other appropriate commercial uses facilitated by the present invention. There are numerous advertisements and messages appropriate for the present invention.

In one aspect of the present invention a urine activated display means is presented for use in a urinal comprising a urinal screen having a front side and a back side, said front side having an upper area and a lower area; a message printed on said upper area of said urinal screen; and a quiescently opaque and actively transparent thermochromic coating covering the message on the upper area of the urinal screen. In another aspect of the present invention a urine activated display means is presented wherein the quiescently opaque and actively transparent thermochromic coating becomes active and transparent at an activation temperature.

In another aspect of the present invention a urine activated display means is presented wherein the quiescently opaque and actively transparent thermochromic coating returns to a quiescent state opaque state at a deactivation temperature. In another aspect of the present invention a urine activated display means is presented wherein the quiescently opaque and actively transparent thermochromic coating becomes active and transparent at the temperature of urine during urination of approximately 98.6 degrees Fahrenheit.

In another aspect of the present invention a urine activated display means is presented wherein the quiescently opaque and actively transparent thermochromic coating returns to its quiescent state at the temperature of rinse water, said rinse water at a temperature relatively cooler than 98.6 degrees Fahrenheit, such that the difference between the cooler rinse water temperature and 98.6 degrees Fahrenheit causes the thermochromic coating to return to its quiescent state. In another aspect of the present invention a urine activated display means is presented wherein the quiescently opaque and actively transparent thermochromic coating returns to its quiescent state at said temperature of rinse water but not at room temperature at substantially 72 degrees Fahrenheit.

In another aspect of the present invention a urine activated display means is presented wherein said urinal screen is shaped so that said screen lies within the bottom of a urinal at an angle of 30 degrees above horizontal. In another aspect of the present invention a urine activated display means is presented for use in a urinal comprising a urinal screen having a front side and a back side, said front side having an upper area and a lower area; a message printed on said upper area of said urinal screen printed using a quiescently transparent and actively opaque thermochromic.

In another aspect of the present invention a urine activated display means is presented wherein the quiescently transparent and actively opaque thermochromic coating becomes active and opaque at an activation temperature. In another aspect of the present invention a urine activated display means is presented wherein the quiescently transparent and actively opaque thermochromic coating returns to a quiescent state transparent state at a deactivation temperature. In another aspect of the present invention a urine activated display means is presented wherein the quiescently transparent and actively opaque thermochromic coating becomes active and opaque at the temperature of urine during urination at approximately 98.6 degrees Fahrenheit.

In another aspect of the present invention a urine activated display means is presented wherein the quiescently transparent and actively opaque thermochromic coating returns to its quiescent state at the temperature of rinse water, said rinse water at a temperature relatively cooler than 98.6 degrees Fahrenheit, such that the difference between the cooler rinse water temperature and 98.6 degrees Fahrenheit causes the thermochromic coating to return to its quiescent state. In another aspect of the present invention a urine activated display means is presented wherein the quiescently transparent and actively opaque thermochromic coating returns to its quiescent state at said temperature of rinse water but not at room temperature at substantially 72 degrees Fahrenheit.

In another aspect of the present invention a urine activated display method is presented for providing a urine activated display means for use in a urinal comprising the steps of providing a urinal screen having a front side and a back side, said front side having an upper area and a lower area; printing a message printed on said upper area of said urinal screen; and covering said message with a quiescently opaque and actively transparent thermochromic coating covering said message on said upper area of said urinal screen; and placing said display means in a urinal.

In another aspect of the present invention a urine activated display method is presented further comprising the step of selecting the quiescently opaque and actively transparent thermochromic coating such that it becomes active and transparent at an activation temperature. In another aspect of the present invention a urine activated display method is presented further comprising the step of selecting the quiescently opaque and actively transparent thermochromic coating such that it returns to a quiescent state opaque state at a deactivation temperature.

In another aspect of the present invention a urine activated display method is presented further comprising the step of selecting the quiescently opaque and actively transparent thermochromic coating such that it becomes active and transparent at the temperature of urine during urination at approximately 98.6 degrees Fahrenheit.

In another aspect of the present invention a urine activated display method is presented further comprising the step of selecting the quiescently opaque and actively transparent thermochromic coating returns to its quiescent state at the temperature of rinse water, said rinse water at a temperature relatively cooler than 98.6 degrees Fahrenheit, such that the difference between the cooler rinse water temperature and 98.6 degrees Fahrenheit causes the thermochromic coating to return to its quiescent state.

In another aspect of the present invention a urine activated display method is presented further comprising the step of selecting the quiescently opaque and actively transparent thermochromic coating returns to its quiescent state at said temperature of rinse water but not at room temperature at substantially 72 degrees Fahrenheit. In another aspect of the present invention a urine activated display method is presented for providing a urine activated display means for use in a urinal comprising the steps of providing a urinal screen having a front side and a back side, said front side having an upper area and a lower area; printing a message printed on said upper area of said urinal screen using a quiescently transparent and actively opaque thermochromic coating; and placing said display means in a urinal.

DETAILED DESCRIPTION OF A PREFERRED EMBODIMENT OF THE INVENTION

The present invention provides an apparatus and method whereby advertising or messages are printed, painted, screened, applied or otherwise incorporated onto a urinal accessory product using thermochromic ink, paint, film or decal. Alternatively the advertising or messages are printed, painted, screened, applied or otherwise incorporated onto the urinal accessory products using non-thermochromic material and covered with thermochromic material in the area of the sanitary product dispenser above the normal water level in the urinal. Upon temperature change, the thermochromic material changes color or opacity/clarity to reveal, change or hide the intended advertising, design or message.

A thermochromic state change is accomplished by exposure to ambient room air, relatively cool flushing water, and relatively warm urine. At room temperature or below (water temperature), the thermochromic coating is in its quiescent or inactive state and its color, opaqueness/clarity is in one state. It changes state upon urination on the thermochromic material. Its color or clarity changes or reveal the works, signs, symbols or logos. The thermochromic material returns to its normal inactive state color or clarity quickly when exposed to flushing water, and more slowly to room temperature if not flushed. In an alternative embodiment, the thermochromic coating returns to its inactive state only on exposure to flushing water.

Thermochromic paint can be made in any color to change to any color. White to black, black to white, red to blue, etc. It can be used to cover a message and the go clear to reveal the message.

Figure 1:
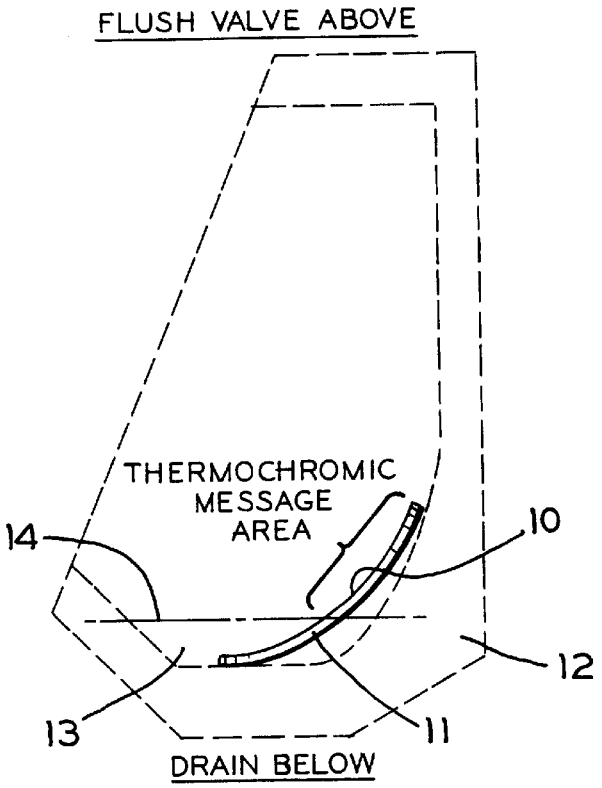
FIG. 1 is a side view of a preferred embodiment of the present invention as used in an operational position in a urinal.

Turning now to the figures, FIG. 1 is a side view of a preferred embodiment of the present invention as used in an operational position in a urinal. In a preferred embodiment, the urinal screen 11 is placed in a urinal 12 so that a lower half of the urinal screen 11 is below the surface 14 of rinse water reservoir 13 retained in the bottom of urinal 12. The upper portion 10 of the urinal screen 11 is above the water line and exposed to ambient air room. The urinal screen 11 is positioned at the lowest point in the urinal and at an angle of approximately 30 degrees relative to the horizontal water surface 14 and 60 degrees relative to a vertical line. Thus, when a male stands in front of the urinal 12, the natural direction of the urinal stream is directed at the urinal screen 11. Thus, because of the relative downward angle of the urine stream and the angle of the urine screen 11, the urine stream strikes the urinal screen 11 at an oblique angle. The oblique angle of attack tends to maximize the longitudinal force component perpendicular to a plane formed in the face of the urinal screen 11 and on the upper portion 10 of the urinal screen 11.

Figure 2:
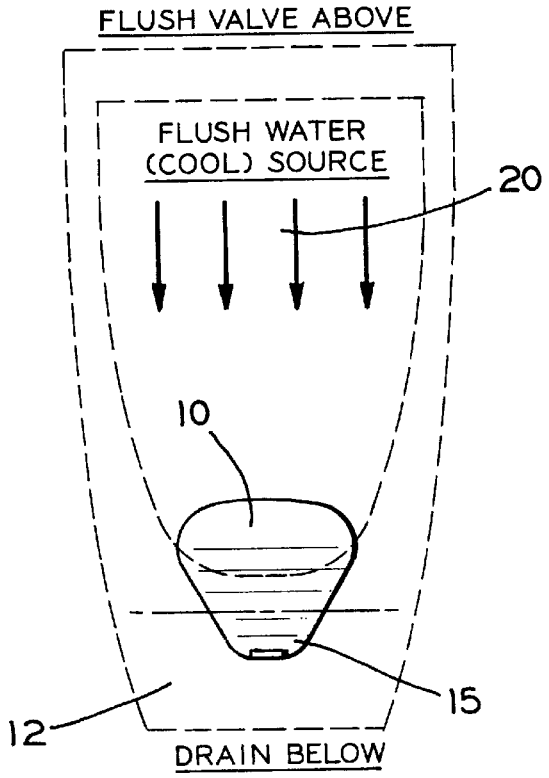
FIG. 2 is a front view of a preferred embodiment of the present invention as used in an operational position in a urinal.

Turning now to FIG. 2, a front view of a preferred embodiment of urinal screen 11 as used in an operational position in a urinal 12. In a preferred embodiment, the upper area 10, located above lower area 15 of the urinal screen, of the urinal screen 11 is in position above the rinse water reservoir surface 14. In a preferred embodiment, as the urinal is flushed, a cool water rinse flows down the back of the urinal and washes over the urinal screen 11 and upper area 10. The cool rinse washes over the upper area 10 of the urinal screen 11 thereby making the entire upper area of the urine screen approximate the temperature of the rinse water.

Figure 3:
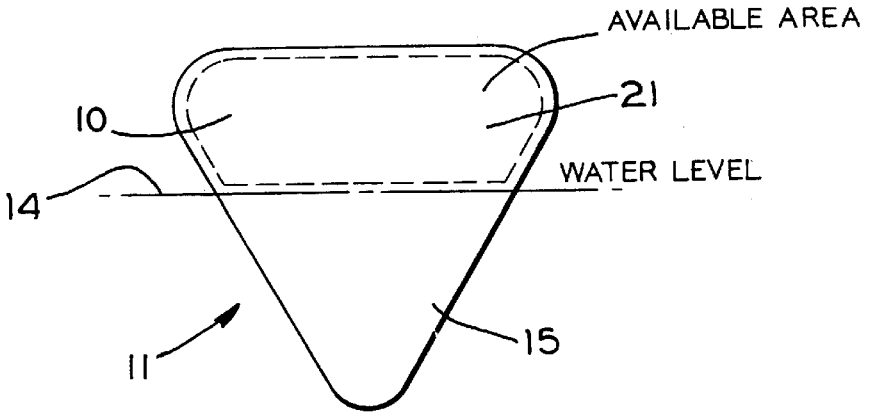
FIG. 3 is a front view of a preferred embodiment of the present invention showing the upper area used for thermochromic coating.

Turning now to FIG. 3, the upper area 10 of the urine screen 11 is shown coated with a thermochromic coating 21. The thermochromic coating 21 is alternately transparent or opaque depending on the temperature to which it is exposed. In one example of a preferred embodiment, the thermochromic coating 21 is opaque in its quiescent state at one temperature and changes to an active transparent state at a slightly higher temperature. Thus, in a preferred embodiment, a message is printed on the upper area 10 and underneath the thermochromic coating 21 and the message is revealed when the thermochromic coating 21 changes to its active state to become transparent.

Figure 4:
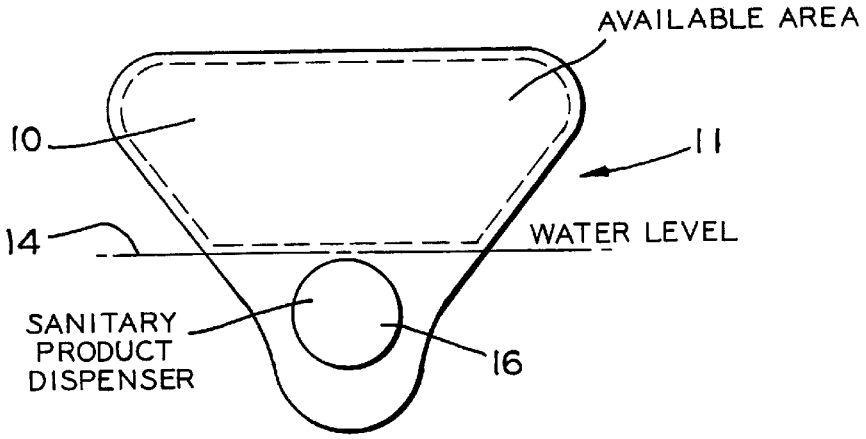
FIG. 4 is a front view of a preferred embodiment of the present invention in combination with a sanitary product dispenser.
Figure 5:
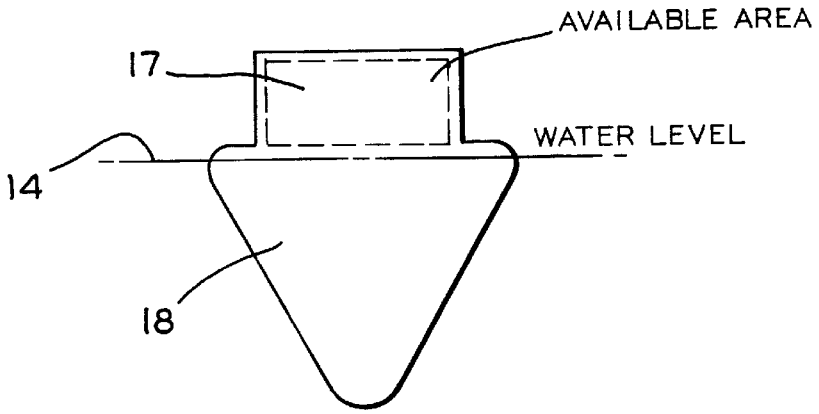
FIG. 5 is a front view of an alternative shape for another example of a preferred embodiment of the present invention.

FIG. 4 is an alternative embodiment of the present invention including a sanitary product dispenser 16. FIG. 5 is an alternative embodiment of the present invention having a triangular lower portion 18.

Figure 6:
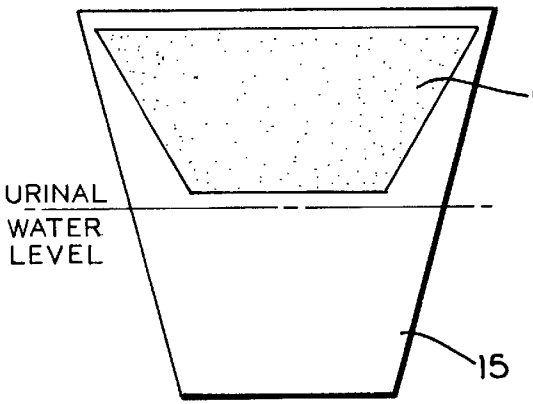
FIG. 6 is a front view of a preferred embodiment of the present invention showing an upper area coated with a quiescently opaque thermochromic coating.

FIG. 6 is a front view of a preferred embodiment of the present invention showing an upper area coated with a quiescently opaque thermochromic coating. Turning now to FIG. 6, in a quiescent state, that is, at room temperature the thermochromic coating 21 is opaque and preferably formulated to contrast with the color of the urinal shield, however, a design matching the color of the urinal shield may be utilized. Thus, at quiescence the thermochromic coating 21 masks the underlying message. However, when a stream of urine at body temperature contacts the thermochromic coating 21, it changes the temperature of the thermochromic coating so that it changes state and becomes substantially transparent revealing the underlying message, logo, advertisement or trademark as shown in FIG. 7.

Figure 7:
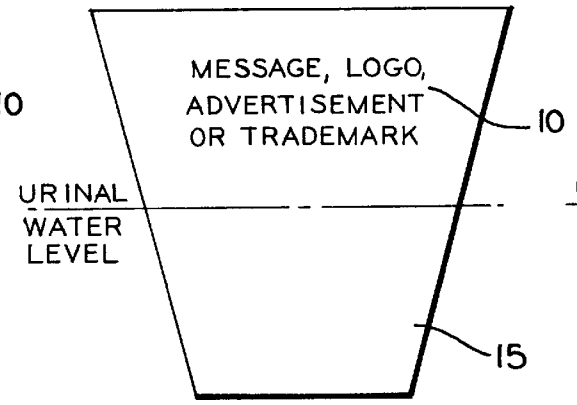
FIG. 7 is a front view of a preferred embodiment of the present invention showing an upper area coated with a quiescently opaque thermochromic coating after the coating has been doused with urine and is in its active transparent state revealing an underlying message.
Figure 8:
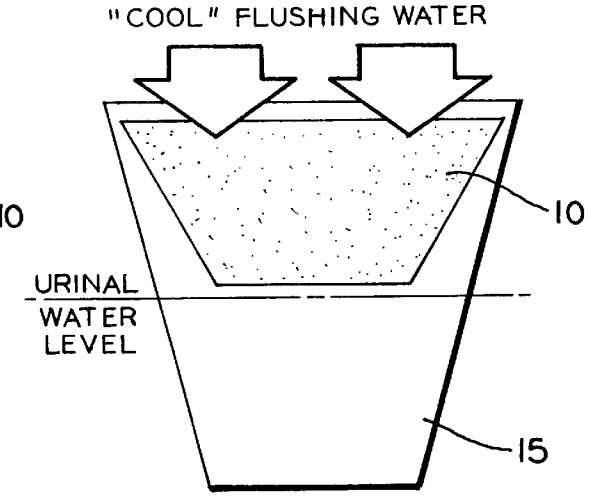
FIG. 8 is a front view of a preferred embodiment of the present invention showing an upper area coated with a quiescently opaque thermochromic coating after the coating has been doused with rinse water or allowed to return to room temperature an underlying message and has returned to its inactive opaque state.

FIG. 7 is a front view of a preferred embodiment of the present invention showing an upper area coated with a quiescently opaque thermochromic coating after the coating has been doused with urine and is in its active transparent state revealing an underlying message. FIG. 8 is a front view of a preferred embodiment of the present invention showing an upper area coated with a quiescently opaque thermochromic coating after the coating has been doused with rinse water or allowed to return to room temperature an underlying message and has returned to its inactive opaque state; As shown in FIG. 8, the thermochromic coating 21 becomes opaque again after the upper area is rinsed with cool rinse water when the urinal is flushed or left exposed to room temperature.

Figure 9:
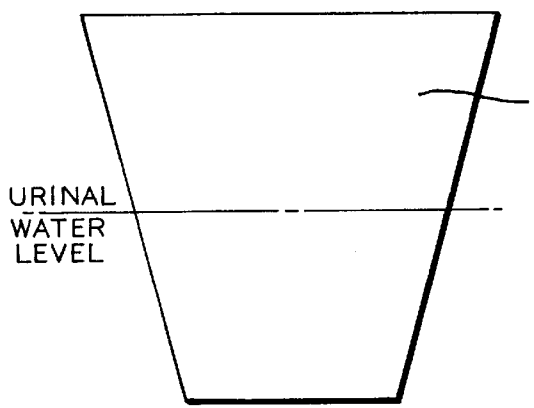
FIG. 9 is a front view of a preferred embodiment of the present invention showing an upper area coated with a quiescently transparent coating.

FIG. 9 is a front view of a preferred embodiment of the present invention showing an upper area coated with a quiescently transparent coating. The thermochromic coating is used to spell out a message, Logo or advertisement. In a quiescent state, that is, at room temperature the thermochromic coating 21 is transparent thus the message is not visible. Thus, at quiescence the thermochromic coating 21 is transparent and effectively masks the message.

Figure 10:
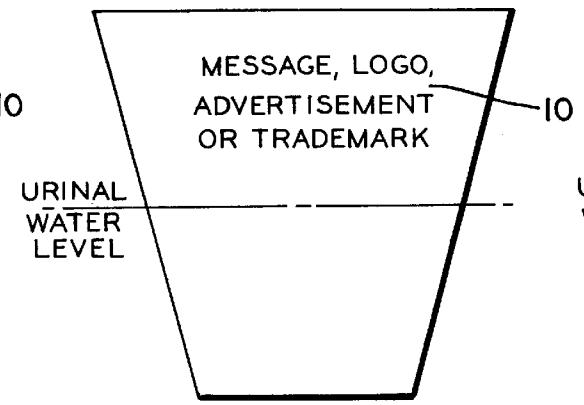
FIG. 10 is a front view of a preferred embodiment of the present invention showing an upper area coated with a quiescently transparent thermochromic coating after the coating has been doused with urine so that the thermochromic coating becomes opaque, revealing the underlying message.

When a stream of urine at body temperature impacts the thermochromic coating 21, it changes the temperature of the thermochromic coating so that it changes state and becomes opaque revealing the message, log, advertisement or trademark as shown in FIG. 10. FIG. 10 is a front view of a preferred embodiment of the present invention showing an upper area coated with a quiescently transparent thermochromic coating after the coating has been doused with urine so that the thermochromic coating becomes opaque, revealing the underlying message.

Figure 11:
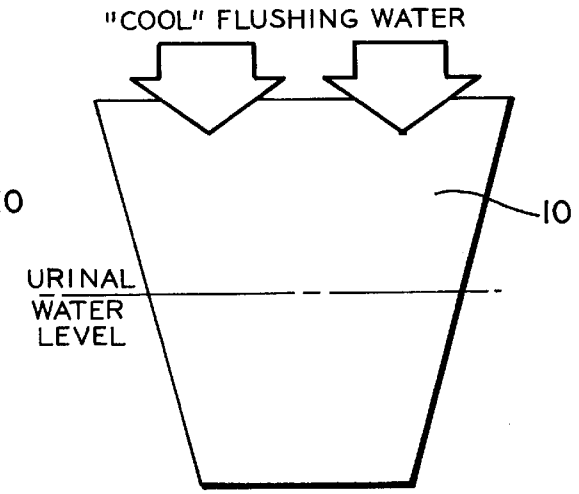
FIG. 11 is a front view of a preferred embodiment of the present invention showing an upper area coated with a quiescently transparent thermochromic coating after the coating has been doused with rinse water or allowed to return to room temperature and has returned to its inactive transparent state.

FIG. 11 is a front view of a preferred embodiment of the present invention showing an upper area coated with a quiescently transparent thermochromic coating after the coating has been doused with rinse water or allowed to return to room temperature and has returned to its inactive transparent state. As shown in FIG. 11, the thermochromic coating 21 becomes transparent again after being rinsed with cool rinse water.

The invention works at a wide range of temperatures as long as the difference between the temperature of the urine at body temperature is detectably different from the ambient temperature to which the thermochromic coating is exposed. It is conceivable that a person of ordinary skill in the art armed with this specification could make changes to the invention to achieve essentially the same result, however, the present invention encompasses all equivalent embodiments of the invention and limited only by the following claims.

What is claimed is:

1. A urine activated display means for use in a urinal comprising:

(a) a urinal screen having a front side and a back side;

(b) a message printed on said urinal screen; and (c) a quiescently opaque and actively transparent thermochromic coating covering said message on said urinal screen.

2. The apparatus of claim 1 wherein the quiescently opaque and actively transparent thermochromic coating becomes active and transparent at an activation temperature.

3. The apparatus of claim 2 wherein the quiescently opaque and actively transparent thermochromic coating returns to its quiescent state at the temperature of rinse water, said rinse water at a temperature relatively cooler than 98.6 degrees Fahrenheit, such that the difference between the cooler rinse water temperature and 98.6 degrees Fahrenheit causes the thermochromic coating to return to its quiescent state.

4. The apparatus of claim 2 wherein the quiescently opaque and actively transparent thermochromic coating returns to its quiescent state at said temperature of rinse water but not at room temperature at substantially 72 degrees Fahrenheit.

5. The apparatus of claim 2 wherein the quiescently opaque and actively transparent thermochromic coating returns to a quiescent state opaque state at a deactivation temperature.

6. The apparatus of claim 1 wherein the quiescently opaque and actively transparent thcrmochromic coating becomes active and transparent at the temperature of urine during urination of approximately 98.6 degrees Fahrenheit.

7. The apparatus of claim 1 wherein said urinal screen is shaped so that said screen lies within the bottom of a urinal at an angle of 30 degrees above horizontal.

8. A method for providing a urine activated display means for use in a urinal comprising the steps of:

(a) providing a urinal screen having a front side and a back side;

(b) printing a message printed on said urinal screen; and (c) covering said message with a quiescently opaque and actively transparent thermochromic coating covering said message on said urinal screen; and (d) placing said display means in a urinal.

9. The method of claim 8 further comprising the step of:

selecting the quiescently opaque and actively transparent thermochromic coating such that it becomes active and transparent at an activation temperature.

10. The method of claim 8 further comprising the step of:

selecting the quiescently opaque and actively transparent thermochromic coating such that it returns to a quiescent state opaque state at a deactivation temperature.

11. The method of claim 8 further comprising the step of:

selecting the quiescently opaque and actively transparent thermochromic coating such that it becomes active and transparent at the temperature of urine during urination at approximately 98.6 degrees Fahrenheit.

12. The method of claim 8 further comprising the step of:

selecting the quiescently opaque and actively transparent thermochromic coating returns to its quiescent state at the temperature of rinse water, said rinse water at a temperature relatively cooler than 98.6 degrees Fahrenheit, such that the difference between the cooler rinse water temperature and 98.6 degrees Fahrenheit causes the thermochromic coating to return to its quiescent state.

13. The method of claim 8 further comprising the step of:

selecting the quiescently opaque and actively transparent thermochromic coating returns to its quiescent state at said temperature of rinse water but not at room temperature at substantially 72 degrees Fahrenheit.

* * * * *

UNITED STATES PATENT AND TRADEMARK OFFICE

CERTIFICATE OF CORRECTION

PATENT NO. : 5,864,848

DATED : January 26, 1999

INVENTOR(S) : Eric Horvitz and Rric S. Finkelstein

It is certified that error appears in the above-identified patent and that said Letters Patent is hereby corrected as shown below:

In column 6, line 52, please delete [CR-ROM] and insert in place thereof -- CD-ROM--

Please change the following text in column 12, lines 40 - 44:

Please delete [ cluster value = $\frac{\overset{k-1}{?}\ la_i - a_{i+1}l}{\frac{1}{k^2}}$ ]

and insert in place thereof: -- cluster value = $\frac{\sum_{1}^{k-1} la_i - a_{i+1}l}{\frac{1}{k^2}}$ --

UNITED STATES PATENT AND TRADEMARK OFFICE

CERTIFICATE OF CORRECTION

PATENT NO. : 5,864,848

DATED : January 26, 1999

INVENTOR(S) : Eric Horvitz and Eric S. Finkelstein

It is certified that error appears in the above-identified patent and that said Letters Patent is hereby corrected as shown below:

Please change the following text in column 22, lines 6 - 12:

Please delete [ cluster value = $\frac{\overset{k-1}{?}\ |a_i - a_{i+1}|}{\frac{1}{k^2}}$ ]

and insert in place thereof: -- cluster value = $\frac{\sum^{k-1} |a_i - a_{i+1}|}{\frac{1}{k^2}}$ --

Signed and Sealed this

Thirty-first Day of August, 1999

*Attest:*

Q. TODD DICKINSON

*Attesting Officer*

*Acting Commissioner of Patents and Trademarks*